US010541098B2

(12) United States Patent
Paul et al.

(10) Patent No.: US 10,541,098 B2
(45) Date of Patent: Jan. 21, 2020

(54) ELECTROMAGNETIC RELAY

(71) Applicant: Tyco Electronics Austria GmbH, Vienna (AT)

(72) Inventors: Indrajit Paul, Vienna (AT); Bernd Adrian, Krems (AT); Rudolf Mikl, Arbesthal (AT)

(73) Assignee: Tyco Electronics Austria GmbH, Vienna (AT)

( * ) Notice: Subject to any disclaimer, the term of this patent is extended or adjusted under 35 U.S.C. 154(b) by 457 days.

(21) Appl. No.: 15/260,765

(22) Filed: Sep. 9, 2016

(65) Prior Publication Data

US 2016/0379785 A1 Dec. 29, 2016

Related U.S. Application Data

(63) Continuation of application No. PCT/EP2015/054928, filed on Mar. 10, 2015.

(30) Foreign Application Priority Data

Mar. 11, 2014 (DE) ..... 10 2014 103 247

(51) Int. Cl.
*H01H 3/00* (2006.01)
*H01H 50/24* (2006.01)
*H01H 50/64* (2006.01)

(52) U.S. Cl.
CPC ..... *H01H 50/24* (2013.01); *H01H 50/641* (2013.01)

(58) Field of Classification Search
CPC .... H01H 50/26; H01H 50/641; H01H 50/041; H01H 50/24; H01H 50/56; H01H 50/14; H01H 50/28; H01H 50/38; H01H 50/54
(Continued)

(56) References Cited

U.S. PATENT DOCUMENTS 2,412,273 A * 12/1946 King ..... H01H 50/24 335/128
2,510,157 A * 6/1950 Towner ..... H01H 50/24 335/128

(Continued)

FOREIGN PATENT DOCUMENTS

CN 101106041 A 1/2008
DE 19848734 A1 5/2000

(Continued)

OTHER PUBLICATIONS

English translation of Chinese Second Office Action, dated Jan. 24, 2018, 9 pages.

(Continued)

*Primary Examiner* — Shawki S Ismail
*Assistant Examiner* — Lisa N Homza
(74) *Attorney, Agent, or Firm* — Barley Snyder

(57) ABSTRACT

An electromagnetic relay is disclosed. The electromagnetic relay comprises a coil, a yoke having a yoke face, and an armature. The armature has an armature face facing the yoke face and movable, depending on a current through the coil, between an open position and a closed position in which the armature face is positioned closer to the yoke face, and an overlap disposed over a side surface of the yoke. A first distance between the side surface of the yoke and the overlap is smaller than a smallest second distance between the armature face and the yoke face in the open position.

18 Claims, 5 Drawing Sheets

(58) Field of Classification Search
USPC ..... 335/187
See application file for complete search history.

(56) References Cited

U.S. PATENT DOCUMENTS 2,547,062 A * 4/1951 Towner et al. ..... H01H 50/24 200/283
2,908,785 A * 10/1959 Stayton ..... H01H 50/24 200/1 A
3,014,103 A * 12/1961 Moran ..... H01H 50/305 200/288
3,243,546 A * 3/1966 Woods ..... H01H 50/305 200/288
3,255,328 A * 6/1966 Krasun ..... H01H 50/24 335/187
3,365,683 A * 1/1968 Aidn ..... H01H 50/26 335/274
3,406,361 A * 10/1968 Le Mauviel ..... H01H 50/26 335/178
3,482,193 A * 12/1969 Krautwald ..... H01H 50/24 335/220
3,501,722 A * 3/1970 Dutkiewicz ..... H01H 50/26 335/192
3,509,502 A * 4/1970 Belanger ..... H01H 49/00 335/129
3,548,139 A * 12/1970 Maynard ..... H01H 49/00 200/293
3,684,986 A * 8/1972 Nagamoto ..... H01H 50/648 335/187
3,736,537 A * 5/1973 Dietsch ..... H01H 50/26 335/135
3,747,035 A * 7/1973 Morimoto ..... H01H 36/00 335/106
3,800,250 A * 3/1974 Mori ..... H01H 50/645 335/128
3,905,590 A * 9/1975 Brunberg ..... H01H 50/58 267/160
3,950,718 A * 4/1976 Nagamoto ..... H01H 51/01 335/79
3,958,198 A * 5/1976 Minks ..... H01H 50/043 335/128
4,216,452 A * 8/1980 Arnoux ..... H01H 1/26 335/128
4,254,392 A * 3/1981 Prohaska ..... H01H 50/041 335/128
4,307,362 A * 12/1981 Kobler ..... H01H 51/2227 335/202
4,323,869 A * 4/1982 Minks ..... H01H 50/26 335/128
4,328,476 A * 5/1982 Bernier ..... H01H 50/24 335/128
4,367,447 A * 1/1983 Koehler ..... H01H 51/2227 335/234
4,439,750 A * 3/1984 Fujii ..... H01F 7/08 335/274
4,490,705 A * 12/1984 Mueller ..... H01H 50/18 335/124
4,491,813 A * 1/1985 Kimpel ..... H01H 51/2245 335/124
4,498,065 A * 2/1985 Nagamoto ..... H01H 51/2236 335/230
4,509,026 A * 4/1985 Matsushita ..... H01H 51/2209 335/132
4,599,593 A * 7/1986 Minks ..... H01H 50/60 335/274
4,602,230 A * 7/1986 Schedele ..... H01H 51/2245 335/79
4,616,201 A * 10/1986 Nagamoto ..... H01H 50/041 335/107
4,621,246 A * 11/1986 Nagamoto ..... H01H 51/2227 335/78
4,658,226 A * 4/1987 Maenishi ..... H01H 50/026 335/121
4,688,010 A * 8/1987 Nobutoki ..... H01H 50/026 335/125
4,689,587 A * 8/1987 Schroeder ..... H01H 50/548 335/121
4,720,694 A * 1/1988 Schroeder ..... H01H 50/548 335/128
4,727,344 A * 2/1988 Koga ..... H01F 7/1646 335/229
4,728,917 A * 3/1988 Kimpel ..... H01H 51/2236 335/229
4,731,597 A * 3/1988 Hinrichs ..... H01H 50/026 335/128
4,734,668 A * 3/1988 Dittmann ..... H01H 50/28 335/128
4,740,769 A * 4/1988 Mitschik ..... H01H 50/60 335/83
4,761,627 A * 8/1988 Bell ..... H01H 50/26 335/128
4,825,179 A * 4/1989 Nagamoto ..... H01H 50/26 335/128
4,870,378 A * 9/1989 Biehl ..... H01H 49/00 335/128
4,933,654 A * 6/1990 Hori ..... H01H 51/2245 335/229
4,951,017 A * 8/1990 Buchschmid ..... H01H 50/28 335/128
4,956,623 A * 9/1990 Kimpel ..... H01H 50/60 335/128
4,958,137 A * 9/1990 Schroeder ..... H01H 1/60 335/128
4,994,776 A * 2/1991 Juncu ..... H01F 7/1615 335/230
5,015,978 A * 5/1991 Yokoo ..... H01H 51/229 335/128
5,017,898 A * 5/1991 Kuzukawa ..... H01H 50/648 335/128
5,070,315 A * 12/1991 Kuzukawa ..... H01H 50/042 335/128
5,081,436 A * 1/1992 Nishi ..... H01H 50/021 335/131
5,396,204 A * 3/1995 Matsuoka ..... H01H 50/04 335/78
5,534,834 A * 7/1996 Hendel ..... H01H 50/28 335/78
5,574,416 A * 11/1996 Maruyama ..... H01H 51/2227 335/78
5,627,503 A * 5/1997 Mader ..... H01H 50/26 335/78
5,748,061 A * 5/1998 Tsutsui ..... H01H 50/28 335/78
5,894,254 A * 4/1999 Reiter ..... H01H 50/28 335/128
7,876,184 B2 1/2011 Mikl et al.
8,207,803 B2 * 6/2012 Iwamoto ..... H01H 50/026 335/128
2003/0062976 A1 * 4/2003 Mochizuki ..... H01H 50/043 335/128
2004/0032310 A1 * 2/2004 Pietsch ..... H01H 50/043 335/128
2006/0066424 A1 * 3/2006 Campbell ..... H01H 50/16 335/128
2006/0181380 A1 * 8/2006 Nakamura ..... H01H 50/043 335/132
2007/0008053 A1 * 1/2007 Mochizuki ..... H01H 50/041 335/128
2007/0257752 A1 11/2007 Mikl et al.
2007/0290776 A1 * 12/2007 Hasenour ..... H01H 50/88 335/62
2010/0060394 A1 * 3/2010 Nagura ..... H01H 9/443 335/189
2010/0066468 A1 * 3/2010 Iwamoto ..... H01H 50/026 335/128
2012/0206223 A1 * 8/2012 Tan ..... H01H 50/642 335/189
2012/0293285 A1 * 11/2012 Kurihara ..... H01H 50/047 335/202

(56) References Cited

U.S. PATENT DOCUMENTS

| | | | | |
|---|---|---|---|---|
| 2013/0057370 | A1* | 3/2013 | Kubono | H01H 50/643<br>335/177 |
| 2013/0293324 | A1* | 11/2013 | Fujimoto | H01H 50/026<br>335/156 |
| 2016/0372286 | A1* | 12/2016 | Kubono | H01H 9/443 |
| 2018/0114658 | A1* | 4/2018 | Takahashi | H01H 50/24 |

FOREIGN PATENT DOCUMENTS

| | | | |
|---|---|---|---|
| EP | 0375398 | A2 | 6/1990 |
| FR | 1022415 | A | 3/1953 |
| FR | 2972844 | A1 | 3/2011 |
| GB | 626746 | A | 2/1947 |
| WO | 9831037 | A1 | 7/1998 |
| WO | 0106527 | A1 | 1/2001 |

OTHER PUBLICATIONS

Abstract of CN101106041, dated Jan. 16, 2008, 2 pages.
Chinese Office Action and English translation, dated Jun. 2, 2017, 13 pages.
PCT Notification, International Search Report and Written Opinion of the International Searching Authority, dated Jun. 2, 2015, 13 pages.
German Office Action, dated Nov. 4, 2014, 10 pages.

* cited by examiner

ELECTROMAGNETIC RELAY

CROSS-REFERENCE TO RELATED APPLICATIONS

This application is a continuation of PCT International Application No. PCT/EP2015/054928, filed on Mar. 10, 2015, which claims priority under 35 U.S.C. § 119 to German Patent Application No. 102014103247.0, filed on Mar. 11, 2014.

FIELD OF THE INVENTION

The present invention relates to an electromagnetic relay, and more particularly, to an electromagnetic relay having a coil, a yoke, and a movable armature.

BACKGROUND

Electromagnetic relays having a coil, a yoke, and a movable armature are known in the prior art wherein the armature has an open position or a closed position depending upon a current running through the coil. The electromagnetic relay generates an electromagnetic force between the armature and the yoke. In the open position, the armature is further away from the yoke than in the closed position.

SUMMARY

An object of the invention, among others, is to provide an electromagnetic relay that, in the open position of the armature, forms a higher electromagnetic force between the yoke and the armature. The disclosed electromagnetic relay comprises a coil, a yoke having a yoke face, and an armature. The armature has an armature face facing the yoke face and movable, depending on a current through the coil, between an open position and a closed position in which the armature face is positioned closer to the yoke face, and an overlap disposed over a side surface of the yoke. A first distance between the side surface of the yoke and the overlap is smaller than a smallest second distance between the armature face and the yoke face in the open position.

BRIEF DESCRIPTION OF THE DRAWINGS

The invention will now be described by way of example with reference to the accompanying figures, of which.

DETAILED DESCRIPTION OF THE EMBODIMENT(S)

The invention is explained in greater detail below with reference to embodiments of an electromagnetic relay. This invention may, however, be embodied in many different forms and should not be construed as limited to the embodiments set forth herein; rather, these embodiments are provided so that this disclosure will be thorough and complete and still fully convey the scope of the invention to those skilled in the art.

An electromagnetic relay 40 according to the invention is shown generally in FIGS. 1-5. The electromagnetic relay 40 has a coil body 1, a yoke 3, and an armature 7. The major components of the invention will now be described in greater detail.

Figure 1:
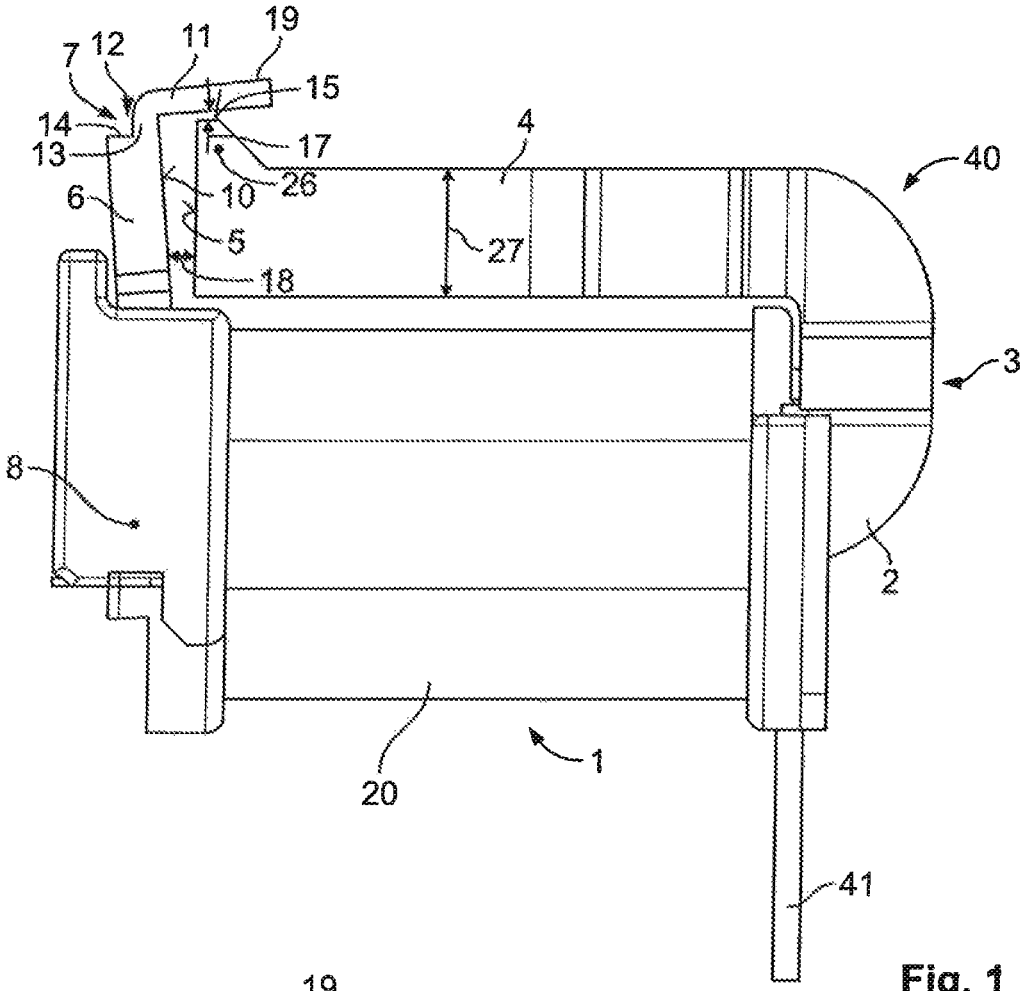
FIG. 1 a side view of an electromagnetic relay according to the invention in an open position.
Figure 4:
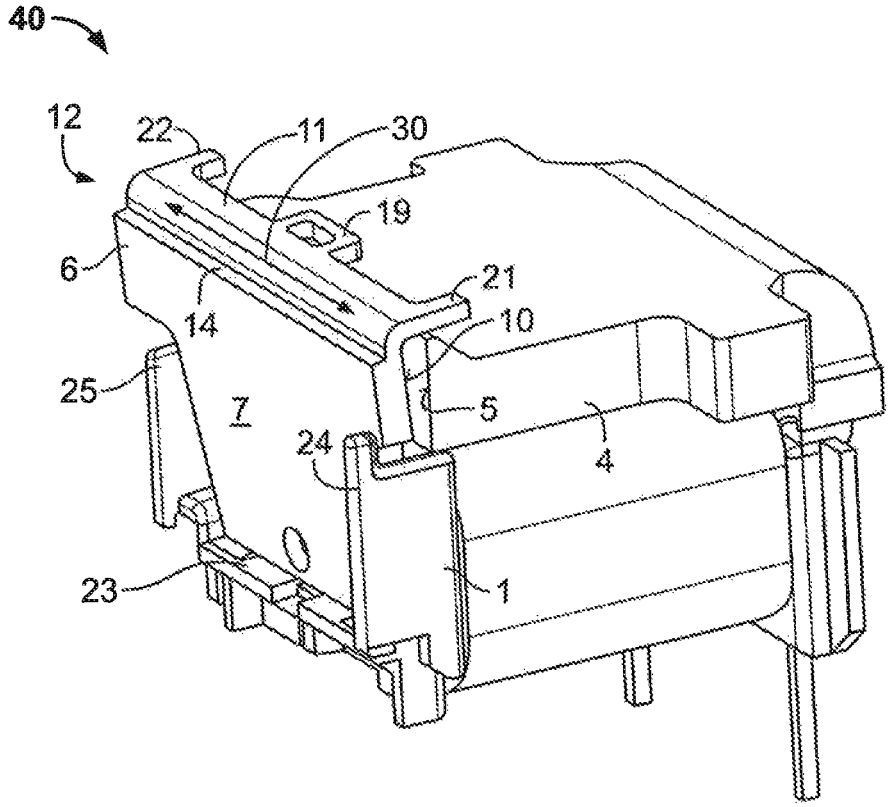
FIG. 4 is a perspective view of the electromagnetic relay of FIG. 1.

The coil body 1, as shown in FIGS. 1 and 4, has a support surface 23, and retaining arms 24, 25 disposed on each side of the support surface 23. A coil 20 is disposed within the coil body 1, and as shown in FIG. 1, the coil 20 is electrically connected to a connector 41.

The yoke 3, as shown in FIG. 1, is formed in a U-shape with a second arm 2 and a first arm 4. The first arm 4 has a yoke face 5, an upper side surface 15, and an edge section 26 bordering the yoke face 5 and which leads to an increase of a height 27 of the first arm 4. The yoke face 5 has a plurality of fixed contacts (not shown). The edge section 26 has an upper edge surface 28, as shown in FIG. 3.

Figure 2:
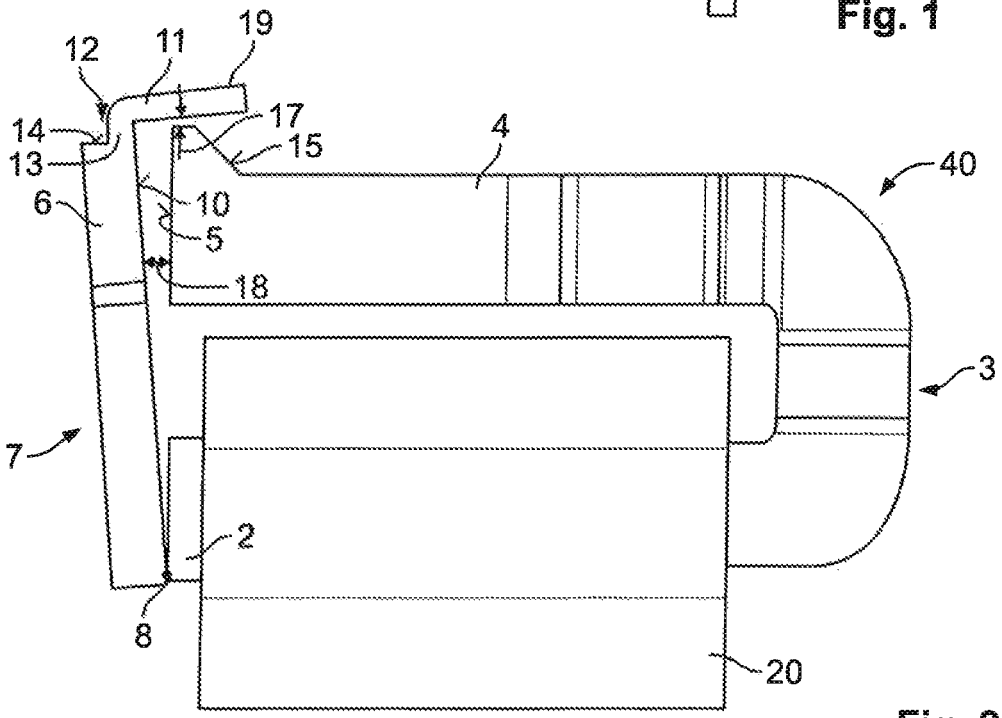
FIG. 2 is a side view of the electromagnetic relay of FIG. 1 with a coil.
Figure 3:
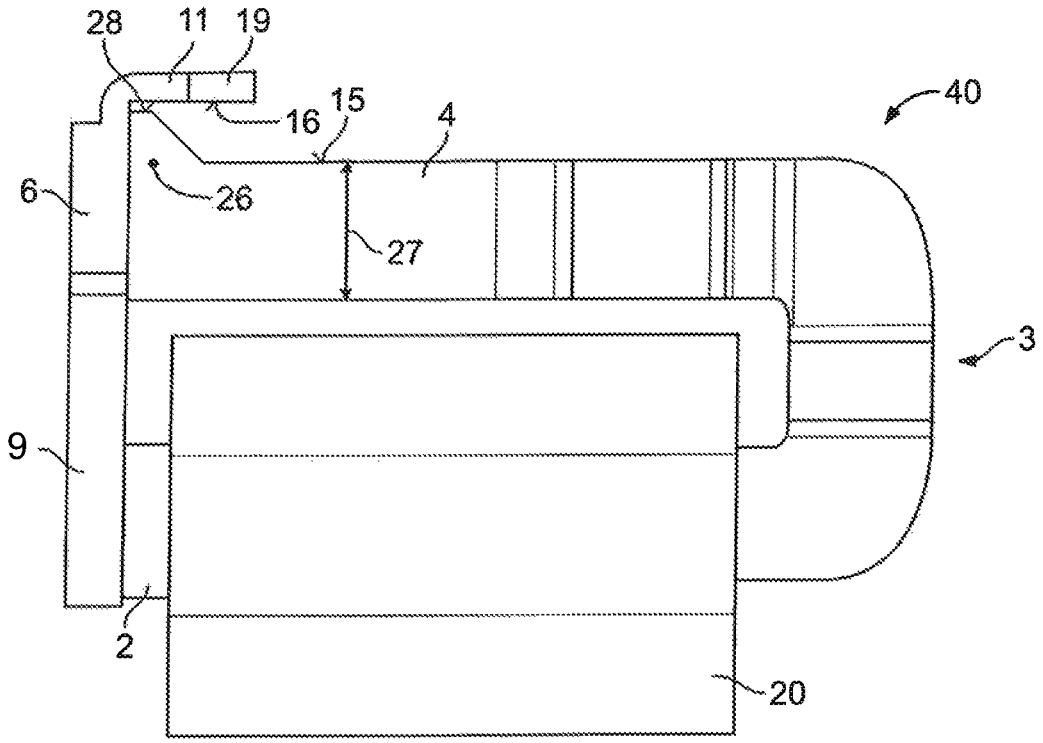
FIG. 3 is a side view of the electromagnetic relay of FIG. 1 in a closed position.

The armature 7, as shown in FIGS. 1-3, has a lower end section 9, an upper end section 6, an overlap 11, and a bar 19. The upper end section 6 has an armature face 10 and an upper end surface 12. As shown in FIG. 4, the upper end section 6 has a width 30. The armature 7 is operatively connected to a movable contact (not shown).

The overlap 11 is a curved, angled section extending from a partial surface 13 of the upper end surface 12 of the upper end section 6, the partial surface 13 being located in a front region of the upper end surface 12. A rear region of the upper end surface 12 has an rear surface 14. In the shown embodiment, the overlap 11 has a thickness of approximately half the thickness of the upper end section 6. The overlap 11 could alternatively have a range of other thicknesses, including a thickness equal to the upper end section 6; in this alternative embodiment, no rear surface 14 is formed. The overlap 11 can also project from the armature face 10. The overlap 11 has a lower side surface 16, as shown in FIG. 3.

The overlap 11 may extend from the whole width 30 of the upper end section 6, or may extend from just a partial region of the width 30. In addition, the overlap 11 can also be made in the form of a number of individual overlaps 11 arranged a distance apart from one another; the individual overlaps 11 can be distributed equal distances apart over the width 30. For example, an overlap 11 can extend from at least 50% of the width 30, or the overlap 11 could extend from at least 90% of the width 30.

The bar 19 projects forward from the overlap 11. The overlap 11, as shown in FIG. 4, may have three bars 19, 21, and 22 projecting forward from the overlap 11.

The assembly of the electromagnetic relay 40 will now be described in greater detail with reference to FIGS. 1-5.

As shown in FIG. 1, the second arm 2 of the yoke 3 extends through the coil body 1 and the coil 20. A first arm 4 of the yoke 3 is located above the coil body 1 and leads out to over a front side of the coil body 1.

The armature 7 is mounted with the lower end section 9 pivotably connected to the second arm 3 of the yoke 3, as shown in FIG. 3, the lower end section 9 rotating about an axis of rotation 8 on the coil body 1. The lower end section 6 of the armature 7 rests pivotably on the support surface 23 of the coil body 1, as shown in FIG. 4. In addition, the retaining arms 24, 25 prevent the armature 7 from tilting too far away from the yoke 3.

The upper end section 6 of the armature 7 is positioned in front of the yoke face 5 in the open position shown in FIG. 1 such that the armature face 10 faces the yoke face 5, but is spaced apart from the yoke face 5. The overlap 11 extends from the armature 7 towards the yoke face 5, the overlap 11 extending through a first plane defined by the armature face 10 and a second plane defined by the yoke face 5 and being positioned above the first arm 4.

Figure 5:
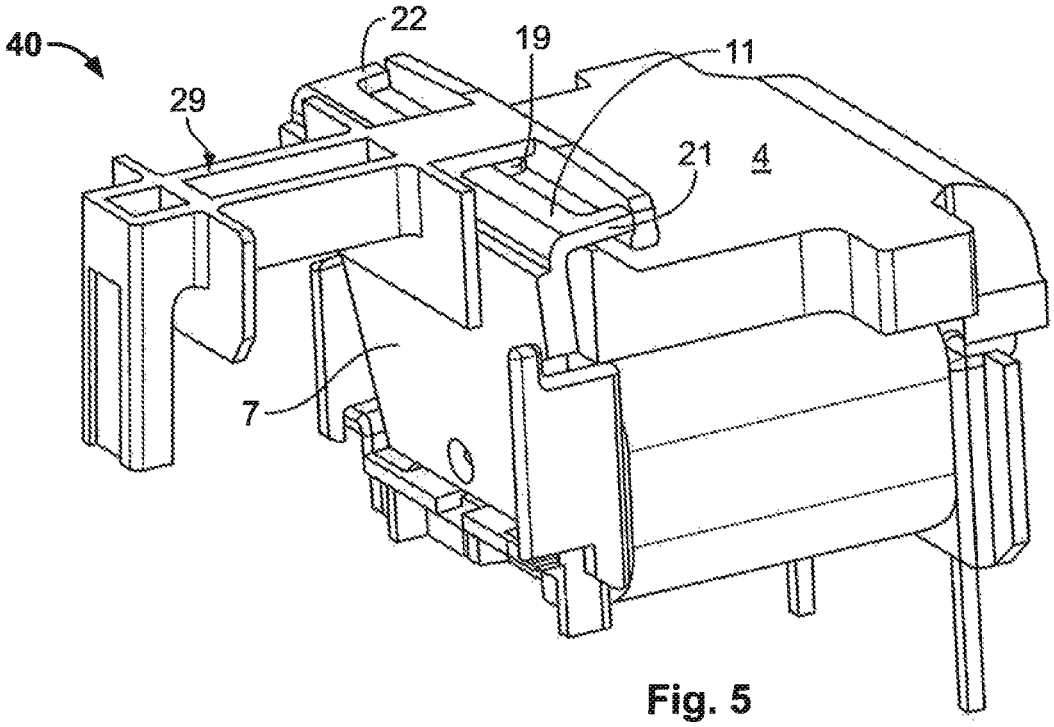
FIG. 5 is a perspective view of the electromagnetic relay of FIG. 1 with a comb.

The bars 19, 21, and 22 are provided in order to fasten a comb 29 to the armature 7, as shown in FIG. 5. The comb 29 is designed to establish an operative connection between the electromagnetic relay 40 and a movable electric contact (not shown). In various embodiments, the comb 29 may be connected to more than one movable electric contact.

The electromagnetic relay 40 is shown in the open position of the armature 7 in FIGS. 1, 2, and 4, in which the yoke face 5 and the armature face 10 are spaced apart from one another by, at a minimum, a smallest second distance 18. In this position, the overlap 11 may nevertheless overlap an upper side surface 15 of the first arm 4. Between the upper edge surface 28 of the edge section 26 of the first arm 4 and a lower side surface 16 of the overlap 11, a first distance 17 is formed that is smaller than the smallest second distance 18. In the open position, the fixed contact (not shown) of the yoke face 5 and the movable contact (not shown) connected to the armature 7 are spaced apart from one another, and are not electrically connected. Due to the small first distance 17, a relatively large electromagnetic flux is formed between the first arm 4 and the upper end section 6 in a de-energized state of the coil 20.

Figure 9:
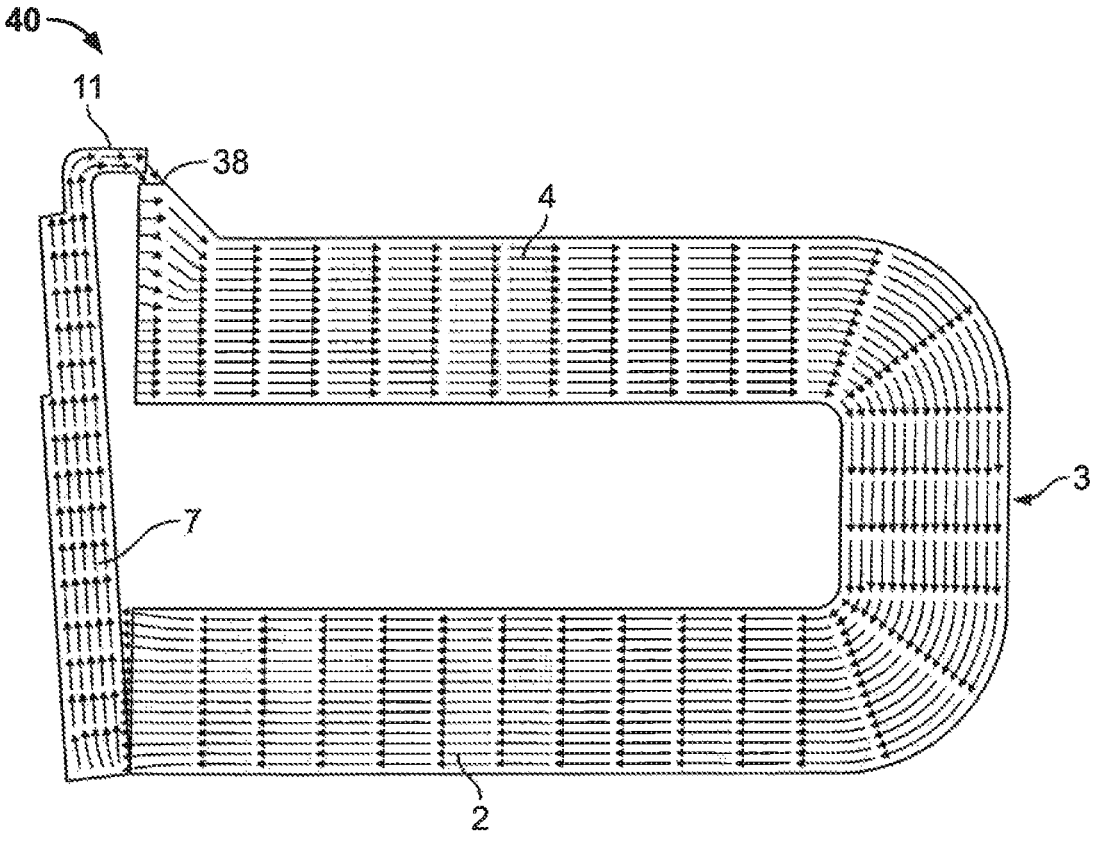
FIG. 9 is a schematic view of a magnetic flux in the electromagnetic relay of FIG. 1.

FIG. 9 shows the course of the magnetic flux of the open position shown in FIG. 1, the magnetic flux being illustrated with the aid of arrows. On the basis of the design of the overlap 11, a magnetic flux 38 between the overlap 11 and the first arm 4 is formed over the first distance 17.

The armature 7 is moved from the open position shown in FIG. 1 to the closed position shown in FIG. 3 when a current is run through the coil 20. In the closed position, the fixed contact (not shown) of the yoke face 5 and the movable contact (not shown) connected to the armature 7 are in contact, producing an electric connection between the contacts. As shown in FIG. 3, in the closed position, the armature face 10 rests against the yoke face 5. Likewise, the lower end section 9 of the armature 7 rests against the second arm 2 of the yoke 3. The upper edge surface 28 of the edge section 26 faces the lower side surface 16 of the overlap 11.

In the closed state, the overlap 11 no longer has any effect upon the electromagnetic flux. The closer the upper end section 6 comes to the yoke face 5, the less significant the effect of the overlap 11, because the second distance 18 continually decreases. As the upper end section 6 comes closer to the first arm 4, the areas and cross sections which are responsible for guiding the magnetic flux increase.

Figure 6:
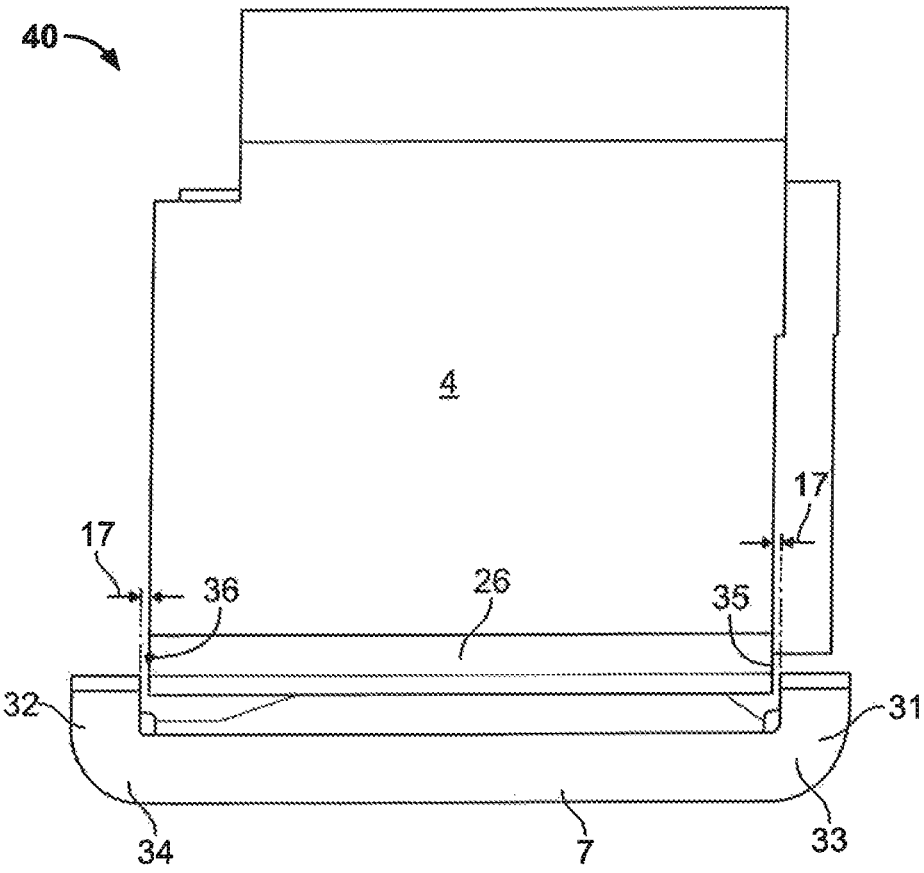
FIG. 6 is a top plan view of another electromagnetic relay according to the invention.
Figure 7:
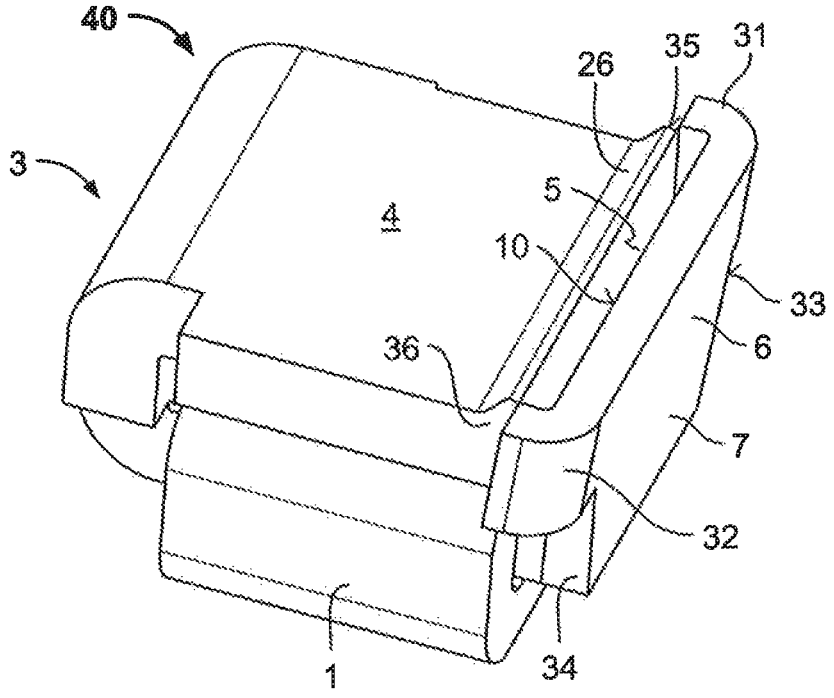
FIG. 7 is a perspective view of the electromagnetic relay of FIG. 6.

Another embodiment of an electromagnetic relay 40 is shown in FIGS. 6 and 7. As shown in FIG. 6, a second overlap 31 and a third overlap 32 are formed, respectively, on a first lateral armature surface 33 and a second lateral armature surface 34 of the armature 7. In the open state of the armature 7, shown in FIGS. 6 and 7, the second overlap 31 and the third overlap 32 overlap a first lateral arm surface 35 and a second lateral arm surface 36 of the first arm 4. In this embodiment, a small space 17 is formed between the armature 7 and the first arm 4 in relation to lateral side surfaces. This embodiment also generates an increased magnetic flux in the open state of the armature 7. In alternative embodiments, just one additional overlap 31, 32 may also be provided.

Figure 8:
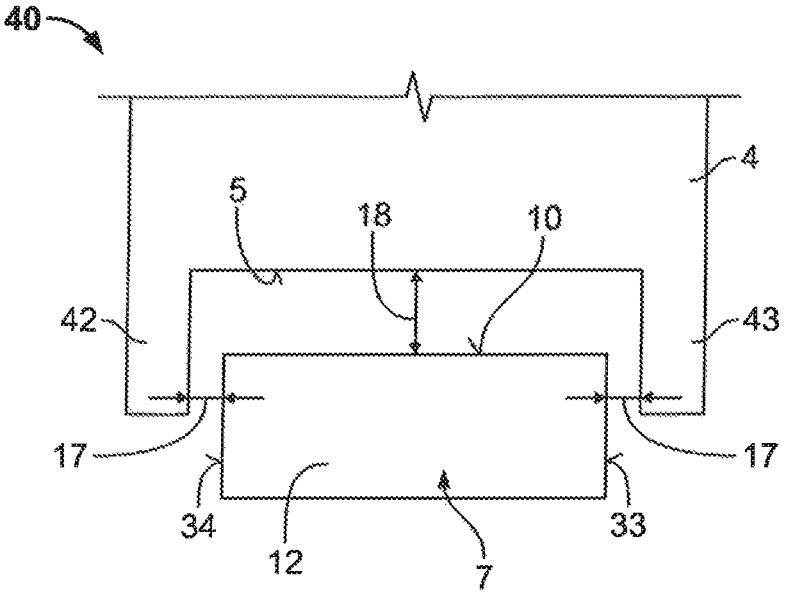
FIG. 8 is a top plan view of another electromagnetic relay according to the invention.

Another embodiment of an electromagnetic relay 40 is shown in FIG. 8. The armature 7 is shown in FIG. 8 in the open position, the armature face 10 of the upper end section 6 being the second distance 18 away from the yoke face 5 of the first arm 4. On opposing sides, the first arm 4 has a fourth and a fifth overlap 42, 43. The fourth and the fifth overlap 42, 43 are arranged with the first distance 17 at the side next to the lateral surfaces 33, 34 of the armature 7. The first distance 17 is smaller than the second distance 18. In alternative embodiments, just the fourth or the fifth overlap 42, 43 may be provided.

In other embodiments, the armature 7 can have both an overlap 11 according to the description of FIGS. 1 to 4 and additional overlaps 31, 32 according to FIGS. 6 and 7. The second and/or third overlap 31, 32 may also just extend over a partial surface of the width of the lateral surfaces 33, 34 of the armature 7, in particular the upper end section 6. The partial surface may be facing the yoke face 5 of the first arm 4 so that a rear region has an end surface.

Advantageously, according to the electromagnetic relay 40 of the present invention, in the open position of the armature 7 a higher magnetic and/or electromagnetic force acts between the armature 7 and the yoke 3 due to the small first distance 17 between them. Consequently, a de-energized contact force between the movable contact and the fixed contact in the closed position can be increased, also increasing a life span of the electromagnetic relay 40. Furthermore, it is not necessary to provide the largest possible surface pairing of the face surfaces 5, 10 of the yoke 3 and armature 7 that are opposite one another. The cross sections of the armature 7 and of the yoke 3 can therefore be made smaller. Additionally, the overlap in various embodiments enables simple manufacturing and a compact structure of the electromagnetic relay 40.

What is claimed is:

1. An electromagnetic relay, comprising:

a coil;

a yoke having a yoke face; and an armature having an armature face facing the yoke face and movable, depending on a current through the coil, between an open position and a closed position in which the armature face is positioned closer to the yoke face, and an overlap disposed over a side surface of the yoke, a first distance between the side surface of the yoke and the overlap smaller than a smallest second distance between the armature face and the yoke face in the open position.

2. The electromagnetic relay of claim 1, wherein the overlap extends through a first plane defined by the armature face and a second plane defined by the yoke face.

3. The electromagnetic relay of claim 2, wherein, in the closed position, the first distance between the side surface of the yoke and the overlap is larger than a smallest second distance between the armature face and the yoke face.

4. The electromagnetic relay of claim 2, wherein the overlap is formed on an upper end of the armature.

5. The electromagnetic relay of claim 4, wherein the overlap is disposed over an upper side surface of the yoke.

6. The electromagnetic relay of claim 5, wherein the overlap extends transversely with respect to the upper end of the armature.

7. The electromagnetic relay of claim 6, wherein the overlap extends from at least 50% of a width of the upper end of the armature.

8. The electromagnetic relay of claim 7, wherein the overlap extends from at least 90% of a width of the upper end of the armature.

9. The electromagnetic relay of claim 4, further comprising a bar projecting from the overlap.

10. The electromagnetic relay of claim 9, further comprising a comb fastened to the bar.

11. The electromagnetic relay of claim 10, wherein the comb is connected to a movable electric contact.

12. The electromagnetic relay of claim 4, wherein the overlap extends from a partial surface located in a front region of the upper end of the armature.

13. The electromagnetic relay of claim 12, wherein the upper end of the armature has a rear surface in a rear region.

14. The electromagnetic relay of claim 2, wherein the overlap extends from a first lateral armature surface of the armature.

15. The electromagnetic relay of claim 14, wherein the overlap overlaps a first lateral arm surface of the yoke in the open position.

16. The electromagnetic relay of claim 15, wherein the armature has a plurality of overlaps.

17. The electromagnetic relay of claim 16, wherein a first overlap extends from the first lateral armature surface of the armature and a second overlap extends from an opposing second lateral arm surface of the armature.

18. The electromagnetic relay of claim 17, wherein the first overlap overlaps the first lateral arm surface of the yoke and the second overlap overlaps an opposing second lateral arm surface of the yoke in the open position.

* * * * *